US005293655A

United States Patent [19]

VanWinkle et al.

[11] Patent Number: 5,293,655

[45] Date of Patent: Mar. 15, 1994

[54] NURSING CRADLE

[76] Inventors: Tresa A. VanWinkle; Larry K. VanWinkle, both of P.O. Box 778, Alamogordo, N. Mex. 88311-0778

[21] Appl. No.: 892,977

[22] Filed: Jun. 3, 1992

[51] Int. Cl.[5] ..... A47D 7/04

[52] U.S. Cl. ..... 5/95; 5/185

[58] Field of Search ..... 5/95, 93.1, 185, 504.1, 5/506.1, 425, 427, 484, 661

[56] References Cited

U.S. PATENT DOCUMENTS

| | | | |
|---|---|---|---|
| 134,847 | 1/1873 | Bryan | 5/95 |
| 328,157 | 10/1885 | Tyler | 5/95 |
| 484,975 | 10/1892 | Perry | 5/95 |
| 884,509 | 5/1908 | Lindsey | 5/95 |
| 920,009 | 4/1909 | Beeland | 5/95 |
| 1,138,451 | 5/1915 | Bugele | 5/95 |
| 1,267,244 | 5/1918 | McMillan | 5/95 |
| 1,495,988 | 6/1924 | Catino | 5/95 X |
| 3,321,779 | 5/1967 | Kaufman et al. | 5/93.1 |
| 3,803,646 | 4/1974 | Newerowski | 5/93.1 X |
| 4,788,726 | 12/1988 | Rafalko | 5/425 X |
| 5,148,561 | 9/1952 | Tharalson et al. | 5/95 |

FOREIGN PATENT DOCUMENTS

| | | | |
|---|---|---|---|
| 185825 | 9/1992 | United Kingdom | 5/95 |

*Primary Examiner*—Michael F. Trettel

*Attorney, Agent, or Firm*—Dennis F. Armijo

[57] ABSTRACT

The disclosure is directed to a nursing cradle for infants that is attached to a bedstead or a waterbed. The disclosure is also directed to a soft wall and cradle sheet to keep an infant from exiting the cradle or getting wedged between a mother's bed and the cradle.

10 Claims, 4 Drawing Sheets

NURSING CRADLE

BACKGROUND OF THE INVENTION

1. Field of the Invention (Technical Field)

The invention relates to a cradle or crib for infants attached to a bedstead with a soft wall and a cradle sheet for ease of breastfeeding and caring for infants. Additionally, the invention can be used as a quilt holder or toddler's loveseat.

2. Background Art

There are several prior art infant beds or cribs that attach to a bedstead. See U.S. Pat. No. 134,847 to Bryan, entitled "Crib-Attachment for Bedsteads"; U.S. Pat. No. 328,157 to Tyler, entitled "Crib"; U.S. Pat. No. 884,509 to Lindsey, entitled "Baby Bed"; U.S. Pat. No. 1,138,451 to Buguele, entitled "Baby Crib"; U.S. Pat. No. 1,267,244 to McMillan, entitled "Crib Attachment"; U.S. Pat. No. 1,495,988 to Catino entitled "Bed Outfit For Nursing Women"; and U.S. Pat. No. 920,009 to Beeland, entitled "Crib Attachment For Bedsteads". The herein described nursing cradle contains significant advances and novel features not found in these prior art devices. This invention provides a novel means for attaching the crib to a bedstead including a waterbed. The present invention also increases the stability of the crib by legs that are height adjustable and mounted to the crib at an angle. Another novel feature of this invention are the stepped side rails. The invention also comprises bumper pads for the back and sides of the crib and also form a soft wall to keep the baby inside the crib. The invention includes a cradle sheet for covering the crib mattress which also extends onto the mother's bed to provide a waterproof barrier between the baby and mother's bed and also keeps the baby from getting wedged between the crib and the mother's bed when the soft wall is not in use.

SUMMARY OF THE INVENTION

Disclosure of the Invention

In accordance with the present invention there is provided a baby crib attached to a bedstead for ease of caring for infants. The invention further provides for infant safety. The preferred invention is a nursing cradle for infants attachable to a bed comprising infant cradle apparatus, structure for affixing said infant cradle apparatus to a bedstead, adjustable leg apparatus, nursing cradle sheet and nursing cradle bumper pad.

The preferred infant cradle comprises a mattress platform, mattress, stepped side rails and a back rail. The preferred stepped side rail comprises side rails comprising a first end at a first predetermined height and a second end at a second predetermined height. The preferred stepped rail has the first predetermined height that corresponds to a height of the back rail.

The preferred structure for a fixing the infant cradle to a bedstead comprises a strap. An alternative strap comprises structure for fastening the strap to a waterbed.

The preferred adjustable leg structure is attached to the infant cradle at a predetermined angle. The preferred adjustable leg structure also comprises structure for adjusting a length of the leg.

The preferred nursing cradle sheet comprises a first portion with structure for encasing a mattress and second portion for covering a soft wall and a predetermined section of the bed. The preferred second portion comprises two layers, one of fabric and a second of waterproof material.

The preferred nursing cradle bumper pad comprises side bumper pads, back bumper pad and a front soft wall. The preferred front soft wall comprises overlapping extensions of said side bumper pads, adjoining said overlapped extensions and structure for removably affixing said adjoined overlapped sections across a front of said infant cradle to prevent an infant from exiting the cradle.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENT

Best Mode For Carrying Out The Invention

Figure 1:
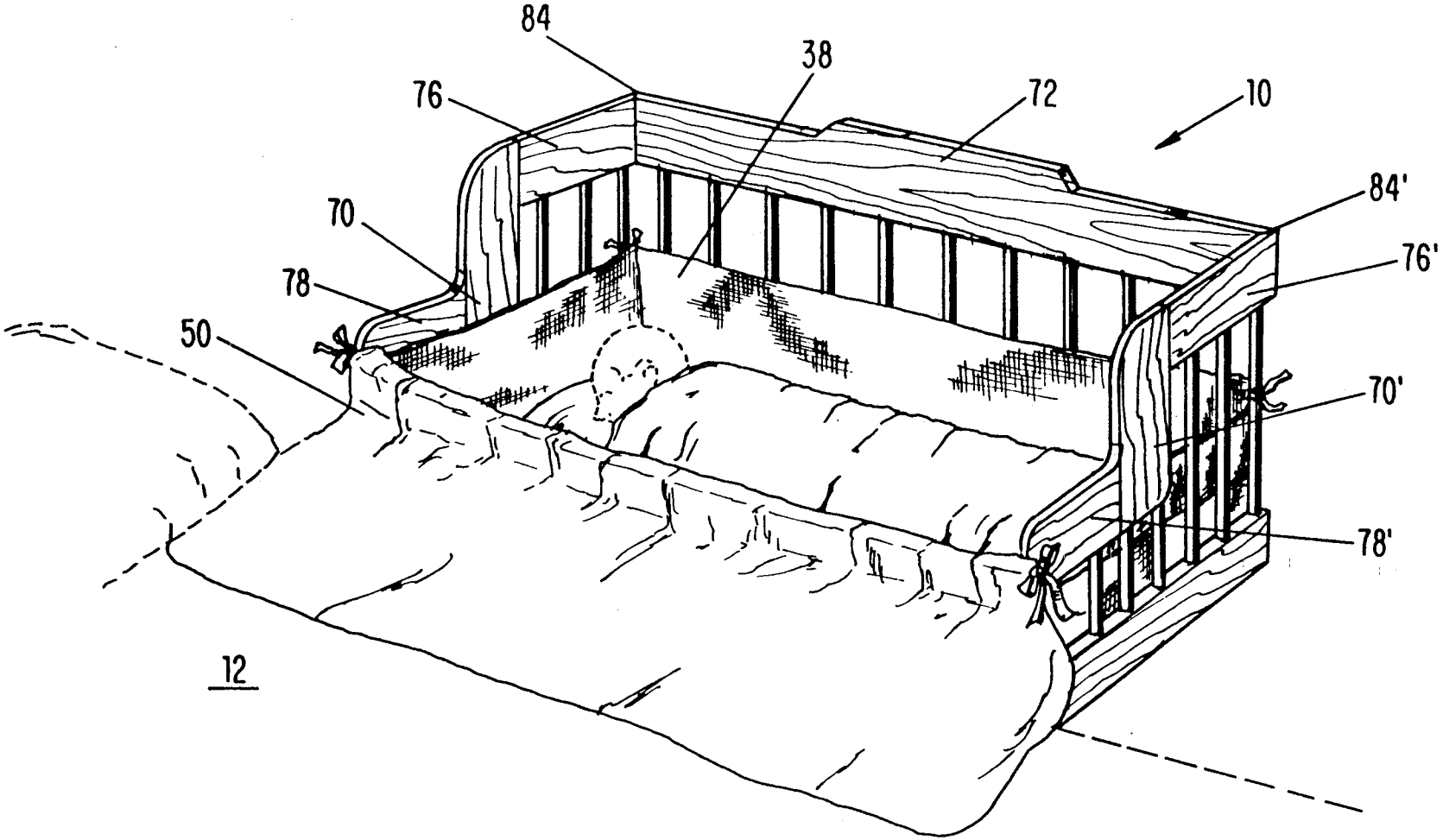
FIG. 1 is a perspective view of the preferred embodiment of the invention.
Figure 2:
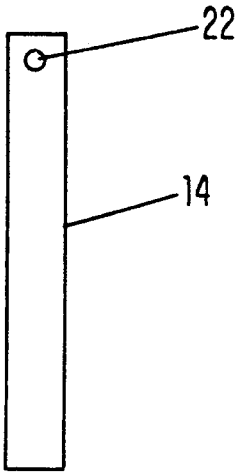
FIG. 2 is a front view of the preferred strap.
Figure 3:
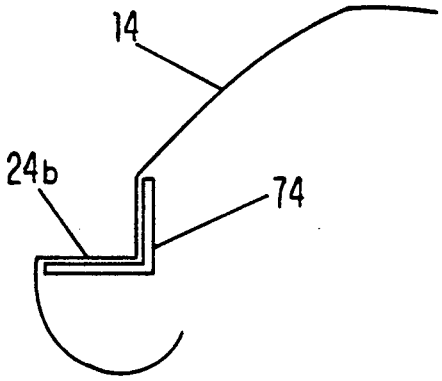
FIG. 3 illustrates the preferred apparatus for attaching the crib to a mother's bed.
Figure 4:
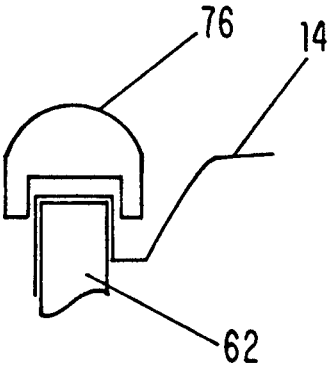
FIG. 4 illustrates an alternative apparatus for mounting the crib to a waterbed.

The following is given in terms of a crib or bed; however the disclosed invention may be employed for other uses, such as a quilt cradle, toddler's loveseat or the like. FIG. 1 is a perspective view of the preferred embodiment of the invention. Crib 10 is attached to mother's bed 12. Crib 10 comprises stepped side rails 70 and 70' and back rail 72. In the preferred embodiment, stepped side rails 70 and 70' comprise rear portion 76, 76' of side rails 70 and 70' at a predetermined height which corresponds with the height of back rail 72. Front portion 78, 78' of side rails 70 and 70' are at a shorter predetermined height than rear portion 76, 76' of side rails 70 and 70'. Ends 84, 84' of back rail 72 are attached to rear portions 76, 76' of side rails 70 and 70'. Bumper pad 38 is attached to back rail 72 and stepped side rails 70 and 70'. Cradle sheet 50 is shown covering soft wall (not shown) and extending onto mother's bed 12. Reference is made to FIG. 2 which shows the preferred strap 14 for attaching crib 10 to the mother's bed 12. In each of the discussed embodiments, two identical straps and attachments are required. The preferred attachment to mother's bed 12 is shown in FIG. 3 with strap 14 being bent to follow the contour of mother's bed frame 74 with box spring **24*b* placed on top of strap 14 as shown. An alternative embodiment is shown in FIG. 4 for attaching crib 10 to a waterbed. Strap 14 is bent to follow the contour of waterbed frame 62 and padded side rail 76 is placed over strap 14 and waterbed frame 62** as shown.

Figure 5:
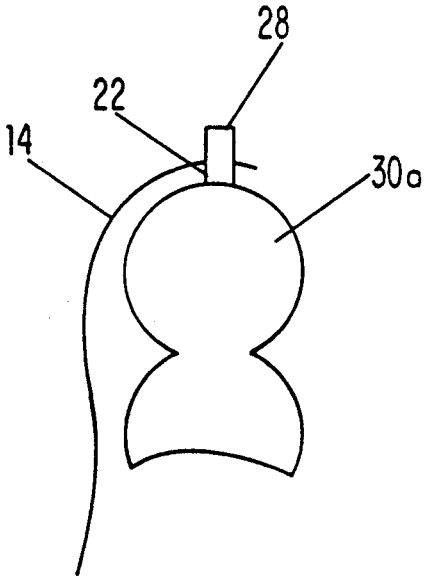
FIG. 5 illustrates how the mounting apparatus is affixed to the crib.

Crib 10 is affixed to each strap 14 by mounting aperture 22 in strap 14, or the like, which is placed onto one crib bolt 28 which is affixed to each adjustable leg **30*a*–30*d* as shown in FIG. 5**.

Figure 6:
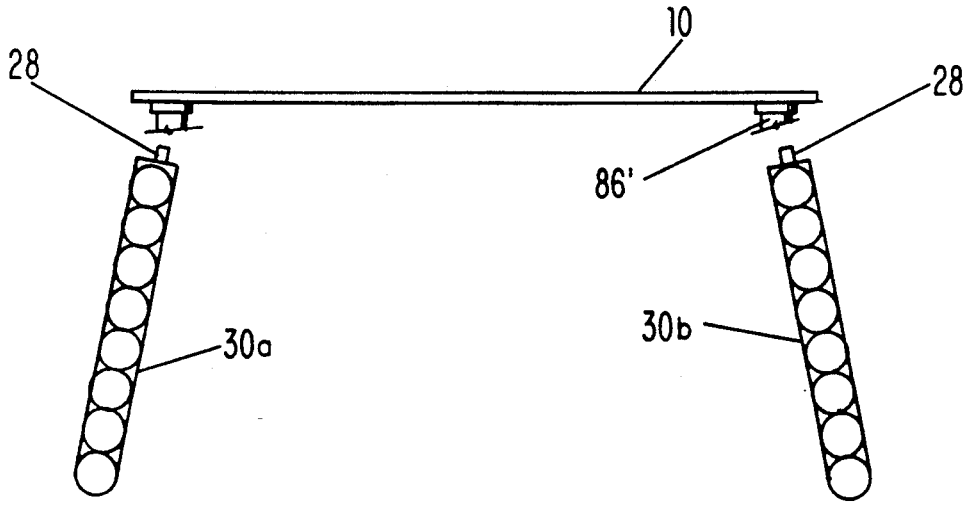
FIG. 6 illustrates the preferred leg configuration of the invention.
Figure 7:
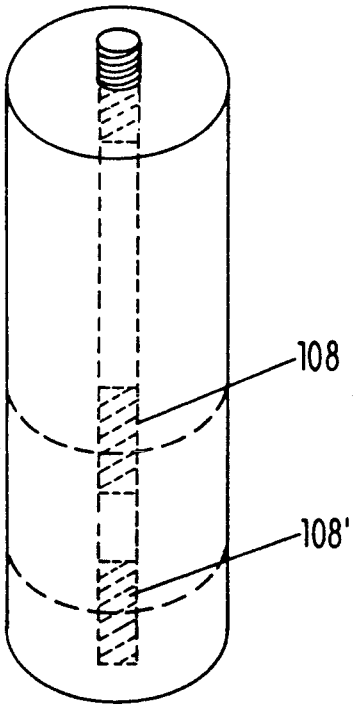
FIG. 7 shows the preferred leg adjustment in accordance with the invention.
Figure 8:
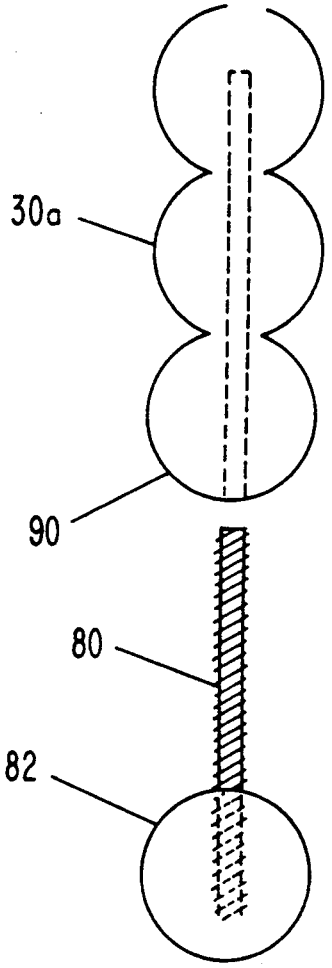
FIG. 8 shows an alternative leg adjustment in accordance with the invention.

Reference is made to FIG. 6 which shows how each adjustable leg **30*a*–30*d* is mounted to crib 10 by a crib bolt 28 at a predetermined angle 86 such as 12 degrees. FIG. 7 illustrates the preferred adjustment embodiment for legs 30*a*–30*d*, each leg being identical. Portions of leg 100 are cut into several predetermined lengths 102, 104 and 106 with threaded rods 108 and 108', or the like, used to join the portions 102, 104 and 106 together. Portions 102, 104 and 106 are added or removed until the desired height is attained. FIG. 8 illustrates an alternative embodiment for the adjustment of legs 30*a*–30*d*. Threaded rod 80 is threaded into bottom portion 82 of each leg. Threaded rod 80 is then threaded in top portion 90 of each leg until the desired height is reached. Crib 10, back rail 72, side rails 70 and 70' and legs 30*a*–30*d*** are preferably made of wood, but can also be constructed of plastic, metal or the like.

Figure 9:
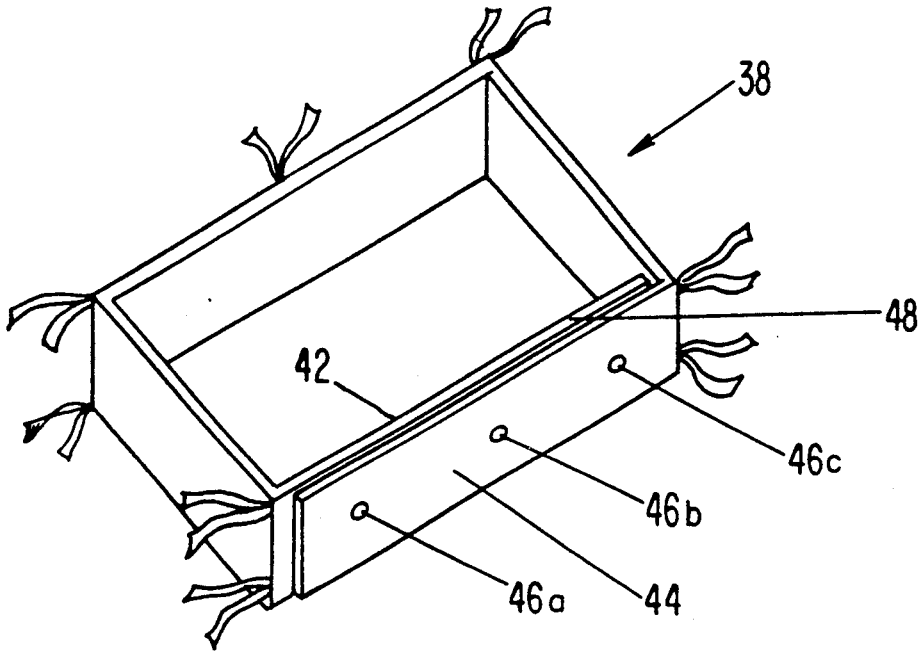
FIG. 9 is a perspective view of the preferred bumper pad of the invention.

Bumper pad 38 as shown in FIG. 9 is made of an easily compressible material such as foam rubber or the like which can be covered with an appropriate fabric, if desired. Ends of bumper pad 42 and 44 are overlapped and fastened by fasteners **46*a*, 46*b* and 46*c* such as buttons, velcro or the like as shown in FIG. 8. Soft wall 48 is created by overlapping a portion of bumper pad 38. Soft wall 48 keeps the baby from rolling or exiting from crib 10**.

Figure 10:
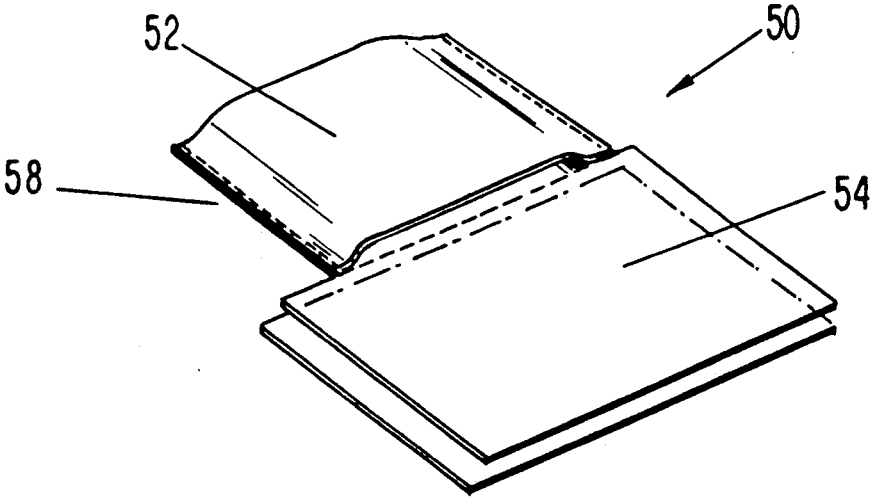
FIG. 10 illustrates the preferred cradle sheet of the invention.

The preferred crib also comprises nursing cradle sheet 50 as illustrated in FIG. 10. Nursing cradle sheet 50 is preferably made out of a soft fabric. Mother's bed portion 54 can be constructed with a waterproof material underneath the fabric or can be made of a waterproof material and sewn to the fabric. Mattress (not shown) is inserted into Baddle 58 of mattress portion 52 as shown in FIG. 10. Mattress portion 52 with mattress (not shown) is inserted into crib 10 with mother's bed portion 54 set on top of soft wall 48, and onto mother's bed 12.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. A nursing cradle for infants attachable to a bed, the nursing cradle comprising:
- infant cradle means comprising:
  - mattress platform means;
  - mattress means;
  - stepped side rail means comprising side rails which comprise a first end at a first predetermined height and a second end at a second predetermined height; and
  - back rail means;
- means for affixing said infant cradle means to a bedstead;
- adjustable leg means;
- nursing cradle sheet means; and
- nursing cradle bumper pad means.

2. The invention of claim 1 wherein said first predetermined height corresponds to a height of said back rail means.

3. The invention of claim 1 wherein said means for affixing said infant cradle means to a bedstead comprises strap means.

4. The invention of claim 3 wherein said strap means is fastened to a side of a waterbed.

5. The invention of claim 1 wherein said adjustable leg means attach to said infant cradle means at predetermined angles, with said predetermined angles other than 90°.

6. The invention of claim 1 wherein said adjustable leg means comprises means for adjusting a length of said leg means.

7. The invention of claim 1 wherein said nursing cradle sheet means comprises:
- a first portion with means for encasing a mattress; and
- a second portion for covering a soft wall and a predetermined section of the bed.

8. The invention of claim 7 wherein said second portion comprises two layers, one of fabric and a second of a waterproof material.

9. The invention of claim 1 wherein said nursing cradle bumper pad means comprises:
- side bumper pad means;
- back bumper pad means; and
- removable front soft wall means, all integrally formed.

10. The invention of claim 9 wherein said removable front soft wall means comprises:
- means for overlapping extensions of said side bumper pad means;
- means for adjoining said overlapped extensions; and
- means for removably affixing said adjoined overlapped sections across a front of said infant cradle means to prevent an infant from exiting said cradle.

* * * * *